US009085061B2

(12) United States Patent
Breitenmoser

(10) Patent No.: US 9,085,061 B2
(45) Date of Patent: Jul. 21, 2015

(54) SANDING PAD LINING CARRIER WITH RECESSES

(75) Inventor: Sepp Breitenmoser, Seedorf (CH)

(73) Assignee: SIA Abrasives Industries AG, Frauenfeld (CH)

( * ) Notice: Subject to any disclaimer, the term of this patent is extended or adjusted under 35 U.S.C. 154(b) by 149 days.

(21) Appl. No.: 13/698,194

(22) PCT Filed: May 16, 2011

(86) PCT No.: PCT/EP2011/057883
§ 371 (c)(1), (2), (4) Date: Nov. 19, 2012

(87) PCT Pub. No.: WO2011/147709
PCT Pub. Date: Dec. 1, 2011

(65) Prior Publication Data

US 2013/0059507 A1 Mar. 7, 2013

(30) Foreign Application Priority Data

May 27, 2010 (EP) ..... 10164153

(51) Int. Cl.
*B24B 21/08* (2006.01)

(52) U.S. Cl.
CPC ..... *B24B 21/08* (2013.01)

(58) Field of Classification Search
CPC ..... B24B 21/08; B24B 21/10
USPC ..... 451/303, 296, 442
See application file for complete search history.

(56) References Cited

U.S. PATENT DOCUMENTS

| | | | | |
|---|---|---|---|---|
| 1,496,471 A * | 6/1924 | Lane | 451/303 |
| 2,199,069 A * | 4/1940 | Fowler | 451/303 |
| 2,624,160 A * | 1/1953 | Harper | 451/303 |
| 2,762,173 A * | 9/1956 | Bottcher | 451/303 |

FOREIGN PATENT DOCUMENTS

| | | |
|---|---|---|
| DE | 951766 | 10/1956 |
| DE | 1145050 | 3/1963 |
| EP | 1716972 | 11/2006 |
| JP | 8141904 | 6/1996 |

* cited by examiner

*Primary Examiner* — Robert Rose
(74) *Attorney, Agent, or Firm* — Davis & Bujold, P.L.L.C.; Michael J. Bujold

(57) ABSTRACT

The present invention relates to a lining carrier for a sanding pad lining, in particular for use with a sanding pad for processing sanding surfaces against workpieces in segment-belt and wide-belt sanding machines. Here, the lining carrier has at least one recess, in particular a groove.

20 Claims, 6 Drawing Sheets

Fig. 3
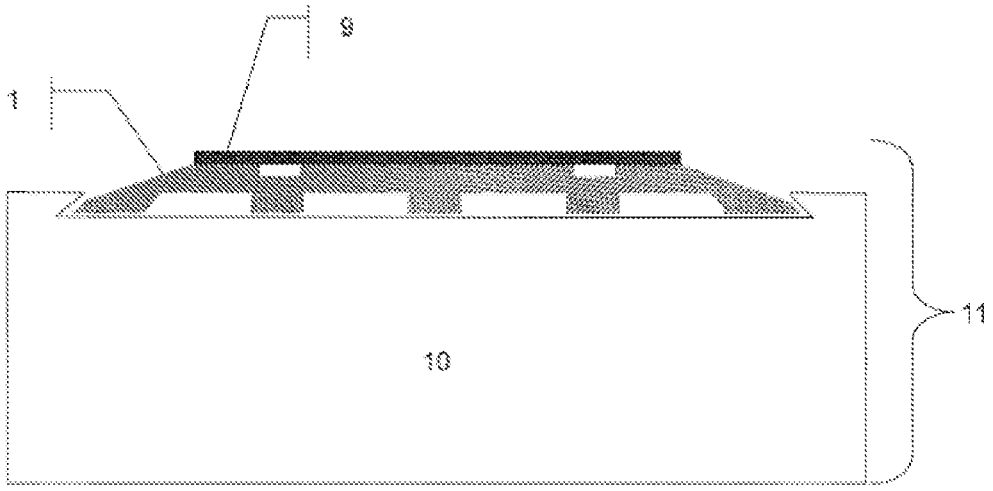
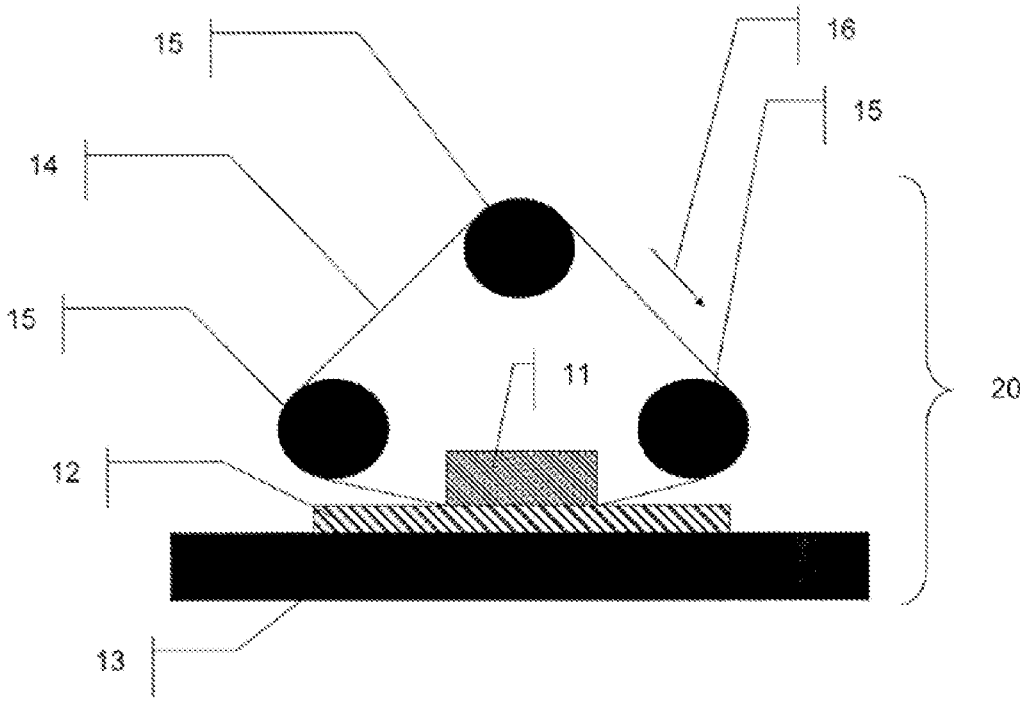
Fig. 4

SANDING PAD LINING CARRIER WITH RECESSES

The present invention relates to a lining carrier for a sanding-shoe lining, in particular for use with a sanding shoe for pressing sanding faces on to workpieces in segment-belt and wide-belt sanding machines. The lining carrier has a sanding lining, which has at least one flat pressure face that is cushioned and/or capable of sliding. Furthermore, the invention relates to a sanding-shoe lining and to a method for producing a lining carrier and a sanding-shoe lining.

In industry, belt sanding machines are used for sanding large-area workpieces, in particular panels of raw material, such as chipboards, MDF, HDF and OSB panels. In these belt sanding machines, a wide sanding belt is driven by rollers and pressed against the surface of the workpiece by means of a sanding shoe.

A sanding shoe has to satisfy several requirements. On the one hand, the friction between the sanding belt and the sanding shoe must be as low as possible. For this reason, the sanding shoe has a sanding-shoe lining, which, during operation, is pressed against the sanding belt and which therefore has a surface that is capable of sliding. The heat produced as a result of the pressure friction must not adversely affect the sanding-shoe lining, for which reason a heat-resistant material is normally used.

Nevertheless, the friction produced in the sanding process results in heat generation and in abrading of the sanding-shoe lining. The generation of heat also causes damage to the lining carrier. Thus, for example, deformations of the lining carrier may occur, making it necessary to replace the lining carrier. In addition, replacement itself is made more difficult by deformations.

Replacement, or covering or fitting the sanding shoe with a new lining carrier provided with a fresh lining, is a time-intensive process. There is therefore a need for a sanding-shoe lining that has an extended service life and that, in addition, can be fitted with little effort.

EP 1 716 972 A1 describes a replaceable sanding-shoe lining that comprises a lining carrier made of non-metallic material. Owing to the use of a non-metallic material, there is a reduced thermal conduction. Consequently, the frictional heat produced in the sanding process is not taken up to a significant extent by the lining carrier, and the latter is less adversely affected as a result. Owing to the compact construction, however, heat may be transferred to the lining carrier.

The lining carrier is normally elongate in form, having a longitudinal axis that, when in the assembled state, extends transversely, or substantially perpendicularly, in relation to the sanding direction. The lining carrier can be slid into a recess of a carrier device, and has stop faces for taking up transverse forces. Furthermore, the lining carrier has a surface that, when in the assembled state, faces toward the carrier device, and has a surface that, when in the assembled state, faces toward the lining, or sanding material.

The object of the present invention is to avoid the disadvantages of the known art. In particular, it is intended to create a lining carrier for a sanding shoe that can be produced inexpensively. In particular, it is also intended to improve the ease of handling and the service life of the lining carrier.

This object has been achieved with a lining carrier and a method for producing a lining carrier for a sanding-shoe lining according to the independent claims of the present invention.

It has been found, entirely unexpectedly, that it is possible to provide a lining carrier for a sanding-shoe lining, in particular for use with a sanding shoe for pressing sanding faces on to workpieces in segment-belt and wide-belt sanding machines, the lining carrier having at least one recess.

The recess is preferably located on the face of the lining carrier that is to face toward the lining and/or the carrier device, and is realized such that the heat exchange can be effected via an air cushion between the lining carrier and a component adjoining the lining carrier or a material applied to the lining carrier.

Such recesses can be realized in the form of holes within or through the entire lining carrier, or as hollows, preferably grooves, on the surface of the lining carrier.

The recess can be punched, milled or drilled into the lining carrier, or the lining carrier can be pressed or cast into a mold that has struts and openings. The pressure face is substantially retained. Alternatively, material can be applied to a basic body, for example bonded as a strip, the recess being formed by the space between the applied materials.

The at least one recess provides for an improved heat exchange between the lining carrier and the ambient air. In addition, in comparison with a solidly realized lining carrier, less material is used and, unexpectedly, there is no loss of stability and durability.

In a preferred embodiment, the recess is formed by two webs that enclose the recess. The said webs together form a recess, in particular a groove, which preferably extends along the longitudinal axis of the lining carrier. The groove can be made on one side or on the other side, such that a cavity is formed between the lining carrier and a lining applied on the lining carrier, or between the lining carrier and a carrier device, in particular a sanding shoe.

In a preferred embodiment, the lining carrier has at least two webs on the side that faces toward the carrier device, e.g. the sanding-shoe lining carrier. As a result, a groove is produced between the lining carrier and the carrier device.

In a further particular embodiment, the lining carrier has at least three, preferably four, webs on the side that faces toward the carrier device. Two to three grooves are thereby produced between the carrier device and the said lining carrier.

In a further particular embodiment, the lining carrier has at least two webs on the side that faces toward the lining. Particularly preferably, the lining carrier has at least three webs. As a result, at least one, preferably two, grooves is/are produced between the lining carrier and the lining fixed to the lining carrier.

In a particularly preferred embodiment, the at least one groove extends continuously on the entire longitudinal axis of the lining carrier.

Such a said groove enables heat to be dissipated, and the disadvantageous effect of heat generation, resulting from friction, can thus be reduced. This has a positive effect upon the service life of the lining carrier. Furthermore, there is a positive effect upon the flexibility of the lining carrier in respect of gravity and pressure force. Moreover, there is a saving in material, because of the lighter construction.

In addition, the lining carrier can have fastening elements made of metal, for example eyelets, which can be easily removed from the sanding-shoe lining for disposal.

The lining carrier according to the invention serves as a support element for a sanding lining, comprising a cushioning and/or a slide face. The cushion material and/or the slide face can be fixedly bonded or welded to the lining carrier, or fixed to it by means of fastening elements, or can be applied as an adhesive lining. Preferably, there is a connection that withstands the tensile, expansion and/or shear forces that occur because of the sanding belt. A lining carrier having a corresponding sanding lining forms a sanding-shoe lining.

The lining carrier produces a connection between the sanding lining and a carrier device. Such a carrier device is, in particular, a sanding shoe, comprising a sanding-shoe lining, furthermore comprising a lining carrier and a sanding lining.

The sanding-shoe lining can be bonded or clamped on to the carrier device/the sanding shoe, or can be fixed with our without additional fastening means, or applied as an adhesive lining. Particularly preferably, the sanding-shoe lining can be slid into a recess of the sanding shoe and fastened.

In an advantageous embodiment of the invention, the lining carrier, together with the lining, has at least one stop face for taking up transverse forces. This stop face, together with a plane parallel to the pressure face, encloses an angle. Preferably, the angle between the stop face and the pressure face is an obtuse angle, i.e. less than 180° and greater than 90°, preferably being approximately 115° to 130°.

In a further preferred embodiment, the lining carrier has a widened portion, which has a swallowtail shape in the transverse axis, on the side that faces away from the lining, or that faces toward the carrier device. This widened portion makes it easier to equip the carrier device, in particular to equip the sanding shoe with the lining carrier.

In a particular embodiment, the lining carrier has a widened portion having a swallowtail shape as described above and, in addition, the support face slopes upward, at an angle of between 4° and 9°, as far as the flat pressure or contact face. This then forms a tapering-in and tapering-out bevel. Alternatively, the swallowtail-shaped widened portion can also be entirely absent, and the lining carrier has merely a tapering-in and tapering-out bevel.

Preferably, a lining carrier according to the invention is composed of a non-metallic material. As a result, the positive effects upon the thermal conduction are increased further. These source materials can be disposed of inexpensively and more easily.

In a preferred embodiment, the lining carrier is composed substantially of a cellulose material, in particular a wood and/or cotton material and/or a polymer material.

Particularly preferably, the material is an MDF, a HDF or a fiber material, i.e. separated cotton. The choice shows the great variability of the materials in respect of their strength or elasticity. The materials can be present in combination, or can each be present singly.

In a particular embodiment, the lining carrier is provided with a lining made of a slide material, preferably graphite or a graphite compound.

Preferably, the sanding-shoe lining is provided with a cushion material.

The cushion material can be interspersed or provided with the slide material, preferably graphite or a graphite compound, at least over a portion of its thickness. The cushion material can have an open-pore structure having a large surface. Preferably, the cushion material is a foam, in particular a PU foam, and/or a felt.

In a preferred embodiment, the lining carrier has a length of between 1000 mm and 5000 mm, in particular between 1200 and 2000 and 4000 mm, particularly preferably between 1400 and 4000 mm. In addition, the lining carrier has a width of between 200 and 60 mm, preferably between 150 and 70 mm, particularly preferably between 115 and 80 mm, measured at the widest location. In a preferred embodiment, the lining carrier is tapered in a swallowtail shape to the side that faces toward the lining. In a lateral profile view, this results in a widest location according to the dimensional specifications given above, and a narrow location, on which the lining is applied. In profile, this narrow location of the lining carrier has a width of between 150 and 20 mm, preferably between 100 and 30 mm, particularly preferably between 90 and 40 mm.

In profile, the thickness of the lining carrier is between 2 and 10 mm, preferably between 3 and 8 mm, preferably between 4 and 5 mm.

A further aspect of the present invention relates to a method for producing a lining carrier for a sanding-shoe lining, in particular for use with a sanding shoe for pressing sanding faces on to workpieces in segment-belt and wide-belt sanding machines. Wherein the lining carrier has at least two webs, such that the said webs form a groove in the longitudinal axis of the lining carrier, between the lining carrier and a lining applied on the lining carrier or a carrier device. Preferably, the method comprises: milling, punching, drilling and/or extruding.

A further aspect of the present invention relates to a sanding-shoe lining for use in a sanding shoe for pressing sanding faces on to workpieces in segment-belt and wide-belt sanding machines. The sanding-shoe lining consists substantially of a lining carrier composed of cellulose material, and a sanding lining composed of a cushion layer and a slide layer. The lining carrier is designed such that it can be fastened in a form-fit manner in or on a sanding shoe. Preferably, the lining carrier has a stop face, in particular a swallowtail-shaped taper, which is realized in a complementary manner on the carrier device. The sanding-shoe lining can thus be fastened into or covered on to the carrier device. The sanding-shoe lining can be fitted into the carrier device in a form-fit manner, apart from at least one recess.

Owing to the recess, a heat exchange can take place between the sanding-shoe lining and the environment during operation. Preferably, webs are realized on the surface of the sanding-shoe lining, thereby creating at least one groove. In a particularly preferred embodiment, the groove can extend continuously in the longitudinal axis, on the entire length of the sanding-shoe lining.

In a further preferred embodiment, there is additionally at least one groove made in the lining carrier, between the lining carrier and the sanding lining.

A further aspect of the present invention relates to a sanding shoe for pressing sanding faces on to workpieces in segment-belt and wide-belt sanding machines. The sanding shoe comprises a carrier device and a sanding-shoe lining. The carrier device is designed in such a way that it can accommodate the sanding-shoe lining substantially with a precise fit. There is at least one recess between the sanding-shoe lining and the carrier device.

The recess can be provided in the sanding shoe and/or in the carrier device.

In a preferred embodiment, the sanding shoe comprises at least one recess, in particular formed by webs and/or grooves on or at the side of the sanding-shoe lining (8) that faces toward the carrier device and/or by webs on or at the carrier device.

In a further preferred embodiment, the carrier device has at least one recess, in particular formed by webs and/or grooves (10). The webs can be bonded-on or welded-on strips, or can result from milled-in or ground-in profiles or grooves. Preferably, they are composed of the same material as the carrier device.

Methods of producing a lining carrier according to the invention have long been known to persons skilled in the art. Extrusion, forming by milling, profile milling and injection molding have proved to be particularly suitable.

The present invention is described more fully in the following with reference to exemplary embodiments and drawings, without being limited thereto.

FIG. 1 shows a schematic drawing of a lining carrier according to the invention, FIG. 2 shows a schematic drawing of a sanding-shoe lining according to the invention, FIG. 3 shows a schematic drawing of a sanding-shoe lining according to the invention, which is clamped into a carrier device, FIG. 4 shows a schematic sectional representation of a belt sanding machine with a sanding shoe, FIG. 5 shows a schematic drawing of an intermediate product in the production of a lining carrier according to the invention, FIG. 6 shows a schematic drawing of a lining carrier according to the invention, FIG. 7*a* shows a schematic drawing of a particular embodiment of the lining carrier according to the invention, FIG. 7*b* shows a schematic drawing of a particular embodiment of the sanding-shoe lining according to the invention, FIG. 8 shows a schematic drawing of a further particular embodiment of the lining carrier according to the invention, FIG. 8*b* shows a schematic drawing of a further particular embodiment of the sanding-shoe lining according to the invention, and FIGS. 9*a* and 9*b* show schematic drawings of exemplary sanding shoe fitted with sanding-shoe linings according to FIGS. 7*a* and 7*b*.

The lining carrier 1 has a substantially swallowtail shape, which tapers toward the side 2 that faces toward the lining (not shown). On the side 2 that faces toward the lining, at the top in the schematic sectional representation of the profile, there are three webs 4*a*, 4*b* and 4*c*. The entire lining carrier has a substantially mirror-symmetrical structure in relation to a vertical symmetry axis. The webs 4*a* and 4*c* are located opposite each other on a notional symmetry axis, and are equal in size. By means of two grooves 5*a* and 5*b*, the web 4*b* divides the side of the lining carrier that faces toward the lining.

The grooves 5*a* and 5*b* are continuous in the entire longitudinal axis of the lining carrier 1.

On the side 3 that faces toward the carrier device (at the bottom in the profile view), there are five webs 6*a*, 6*b*, 6*c*, 6*d* and 6*e*. As a result, four grooves 7*a*, 7*b*, 7*c* and 7*d* of substantially the same shape are created on this side.

Figure 2:
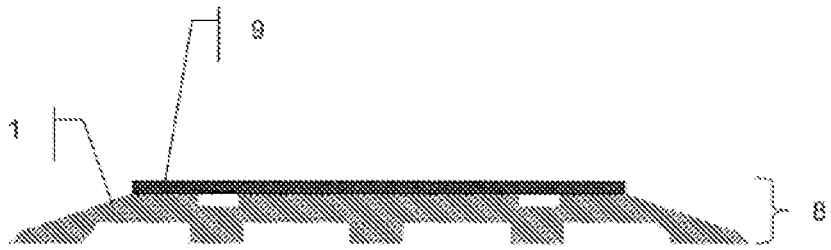

FIG. 2 shows a schematic profile view of a second exemplary embodiment of a sanding-shoe lining 8. A lining 9 fastened to the lining carrier 1 is likewise shown schematically. The lining 9 is composed of felt or foam, which is interspersed over its thickness with a slide material, preferably with graphite or a graphite compound.

FIG. 3 shows a schematic profile view of an exemplary embodiment of a sanding shoe 11 according to the invention. The lining carrier 1 and a carrier device 10 together form the sanding shoe 11. The design of the lining carrier profile in a swallowtail shape enables it to be inserted in a guide rail. This makes it easier to cover the sanding shoe 11. A lining 9 is also applied to the lining carrier. The lining 9 is composed of a cushion material of felt or foam. The felt or foam lining 9 has a thickness of 3 to 4 mm, preferably of 3 to 3.5 mm. The felt preferably has a volume weight of approximately 0.2 to 0.7 g/cm$^3$. Felts and foams suitable for the embodiment according to the invention are obtainable, for example, under the designation wool felt, from VFG, in Gingen, Germany. Hot-melt, or PU adhesive, can be used to fasten the felt 9 to the lining carrier 1. The carrier device 10 is composed of aluminum.

FIG. 4 shows a schematic sectional representation, in profile, of a belt sanding machine 20 with a sanding shoe 11. A workpiece 12 is conveyed on a sanding table 13 under a revolving sanding belt 14. The sanding belt 14 is driven in a running direction 16 by three drive rollers 15 and is pressed against the workpiece 12 by the sanding shoe 11.

Figure 5:
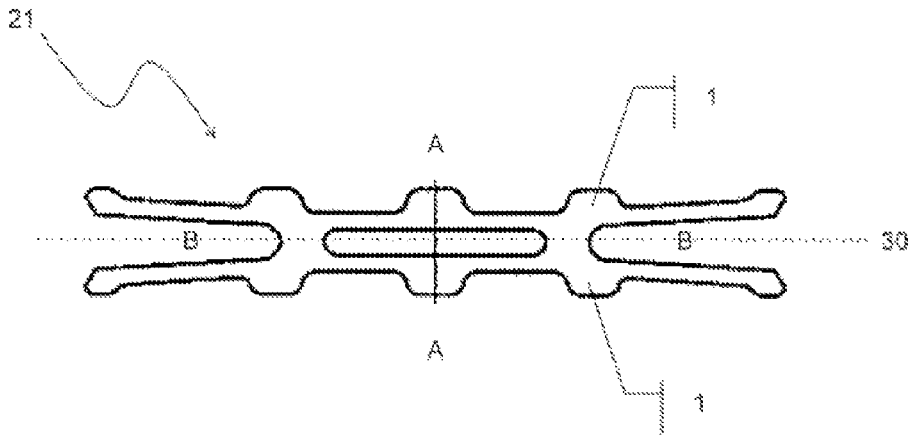

FIG. 5 shows an intermediate step in a method of producing a lining carrier 1 according to the invention. Following fabrication, the blank 21 is divided, in a cutting plane 30, into two lining carriers 1. The resulting lining carriers 1 have five webs on the side A that faces toward the carrier device. Four grooves are created as a result. The side B of the lining carrier 1 that faces toward the lining can also be sanded smooth, if necessary, before a lining is applied.

Figure 6:
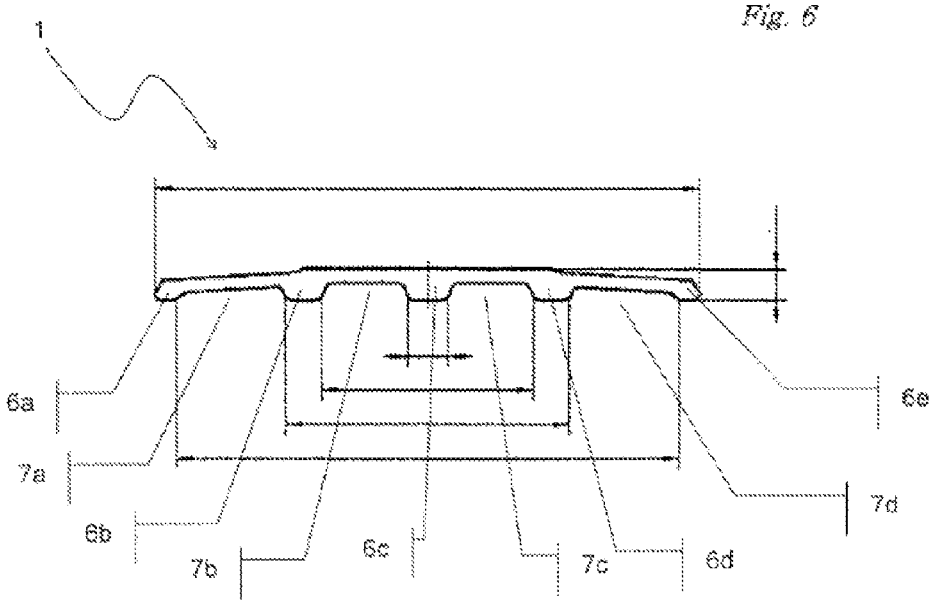

A further particular embodiment of the lining carrier 1 according to the invention is shown in FIG. 6. In the profile view, the lining carrier has a width of 82.3 mm. The thickness is 4.7 mm. The lining carrier 1 has a symmetrical structure. The webs 6*b*, 6*c* and 6*d* are 7.6 mm-8.0 mm wide, and are 12.4 mm-12.8 mm apart in total. This results in two central grooves 7*b* and 7*c*, which are each 12.6 mm wide. The lining carrier is furthermore tapered in a swallowtail shape in relation to the side that faces toward the lining. Two further webs 6*a* and 6*e* are located at the tapering-out ends of the swallowtail-shaped boundary at the sides of the lining carrier 1. Two further grooves 7*a* and 7*d*, each of 16.15 mm in width, are created as a result. The lining carrier 1 has a length of 685 mm.

Figure 7A:
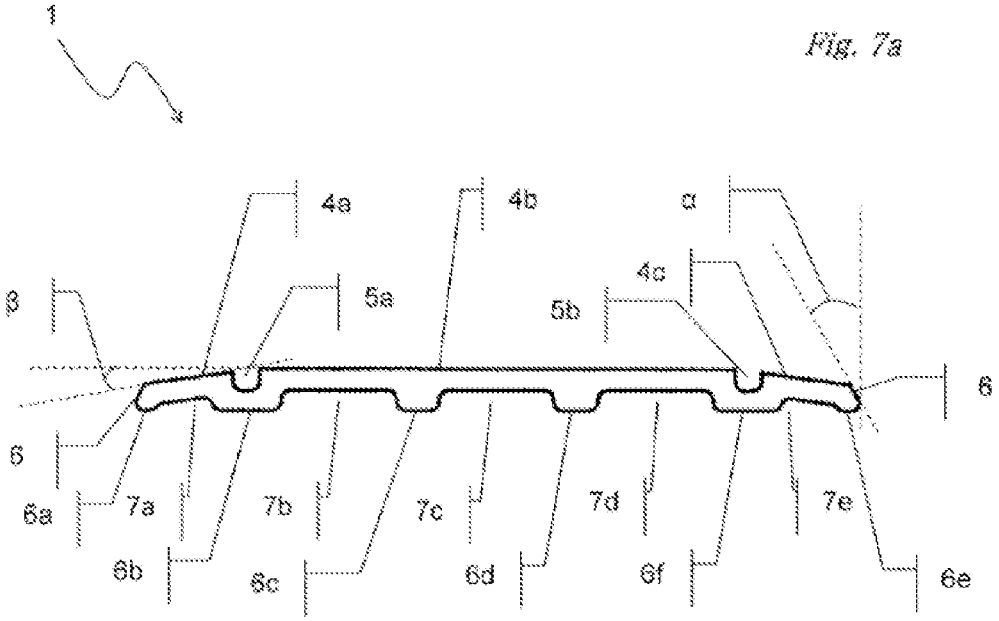

FIG. 7*a* shows a particular embodiment of the lining carrier 1 according to the invention. The lining carrier 1 has the previously described, substantially swallowtail shape at the ends 6*a*, 6*f*, with an angle of inclination of 30° in relation to the normal of the pressure face. On the top side (facing toward the lining), there are three webs 4*a*, 4*b* and 4*c*, such that two grooves 5*a* and 5*b* are formed. On the underside (facing toward the carrier device), there are six webs 6*a*, 6*b*, 6*c*, 6*d*, 6*e* and 6*f*, which, in turn, results in five grooves 7*a*, 7*b*, 7*c*, 7*d* and 7*e*. At the lateral ends 6*a* and 6*f*, the swallowtail graduates into a tapering-in and tapering-out bevel that, at the same time, forms the webs 4*a* and 4*c*. The grooves 7*a* and 7*e* created by the webs of the swallowtail 6*a* and 6*f* and the webs 6*b* and 6*d* are disposed parallel to the tapering-in and tapering-out bevels 4*a* and 4*b*.

The lining carrier 1 has a profile width of between 80 and 85 mm, and in particular between 82.2 and 82.4 mm. The web 4*b* is 54 mm wide, the webs 4*a* and 4*c* are each 11.15 mm. The lining carrier 1 is 4.6 mm-4.8 mm thick at the thickest location, and 2-3 mm, in particular 2.4-2.6 mm, at the thinnest locations. The lining carrier 1 has a length of between 2000 mm and 3500 mm, in particular 3420 mm-3440 mm.

The grooves 5*a*, 5*b* have a width of 2.5 mm-3.5 mm, in particular 2.9 mm-3.1 mm.

The swallowtail-shaped stop faces 6 enclose an angle a of preferably 30° with the vertical (which is perpendicular to the pressure face).

The tapering-in and tapering-out bevels 4*a*, 4*c* enclose an angle β of 4-4.5°, in particular 4.32°, with the pressure face.

Figure 7B:
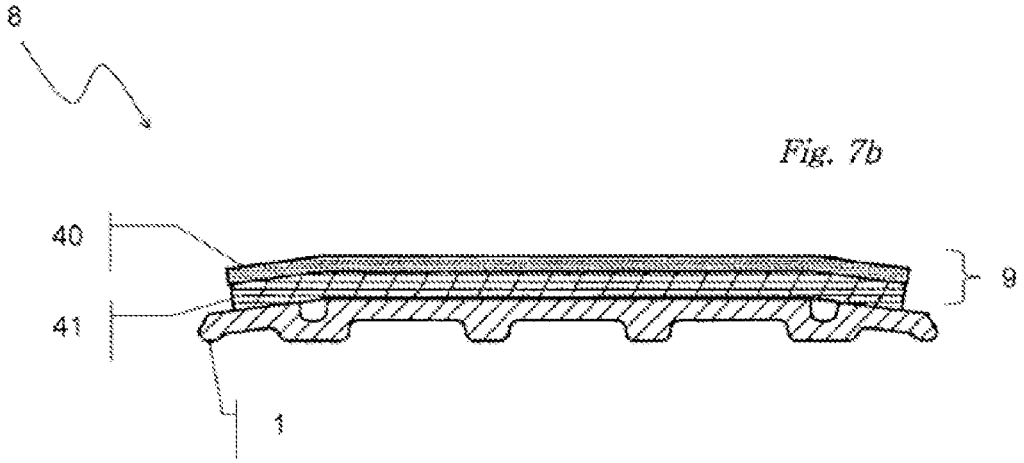

FIG. 7*b* shows a sanding-shoe lining 8 with a lining carrier 1 as shown in FIG. 7*a*. A lining 9 has been applied to the lining carrier. The lining 9 is composed of a cushion layer 40 and a slide layer 41. Synthetic needle felt has been used for the cushion layer 40. For soft cushions, PU foam can also be used.

Figure 8A:
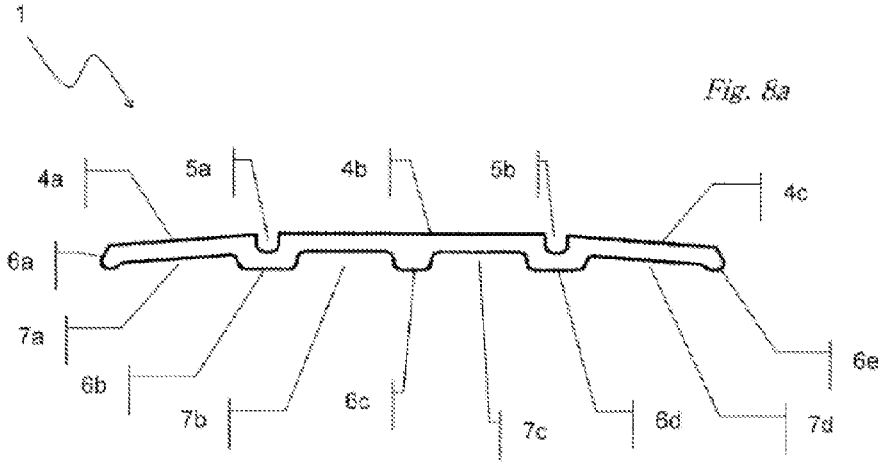

FIG. 8*a* shows a further particular embodiment of the lining carrier 1 according to the invention. The lining carrier has five webs 6*a*, 6*b*, 6*c*, 6*d* and 6*e* on the side that faces toward the carrier device, from which four grooves 7*a*, 7*b*, 7*c* and 7*d* are created. On the side that faces toward the workpiece there are three webs 4*a*, 4*b* and 4*c*, and two grooves 5*a* and 5*b* result from these.

Figure 8B:
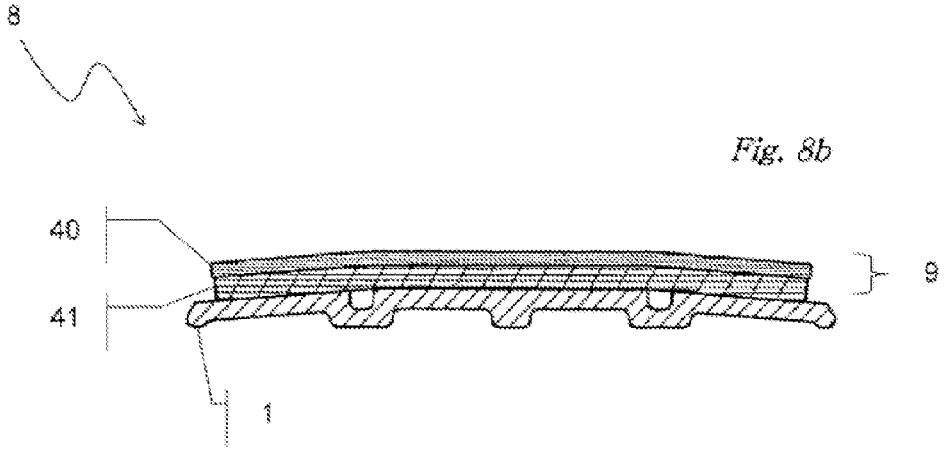

FIG. 8*b* shows a further particular embodiment of a sanding-shoe lining 8 according to the lining carrier 1 from FIG. 8*a*.

Figure 9A:
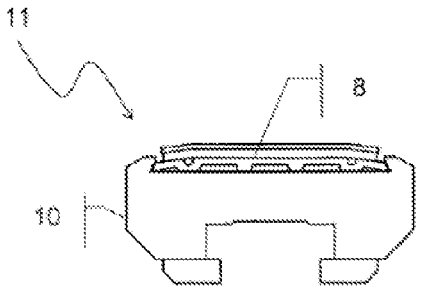
Figure 9B:
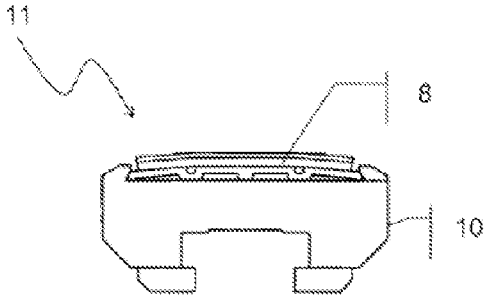

FIGS. 9*a* and 9*b* show sanding shoes 11 fitted with sanding-shoe linings 8 according to the invention. The sanding-shoe linings 8 are fixed to the carrier device 10 by means of the swallowtail-shaped profile sides.

Figure 10:
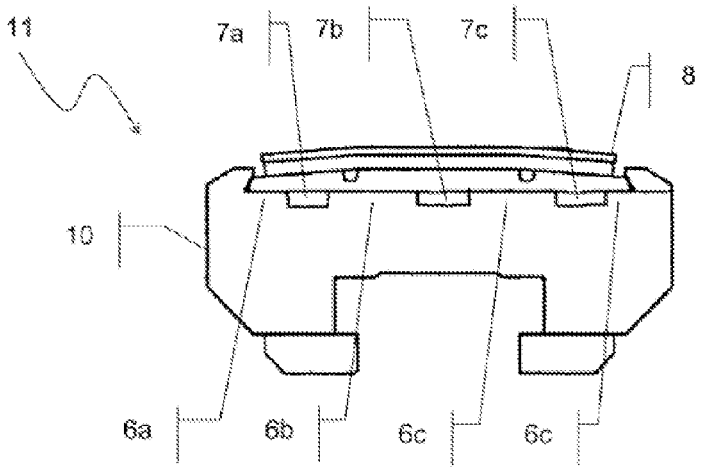
FIG. 10 shows a schematic drawing of an alternative embodiment of the present invention.

FIG. 10 shows an alternative embodiment of the present invention. A sanding shoe 11 has been fitted with a conventional sanding-shoe lining 8, which has no recesses or webs on the face that faces toward the carrier device 10. The carrier device, however, has the webs 6*a*, 6*b*, 6*c* and 6*d*. This results in the recesses 7*a*, 7*b* and 7*c* between the carrier device 10 and the sanding-shoe lining 8. The recesses 7*a*, 7*b*, 7*c* can extend as grooves 7*a*, 7*b*, 7*c* over the entire length of the sanding shoe 11. The webs 6*a*, 6*b*, 6*c*, 6*d* can be bonded on or can be part of the profile structure of the carrier device.

Suitable materials for production of the lining carrier according to the invention are, in particular, MDF or HDF or chipboards or WPC ("wood plastic composite").

Above all, MDF panels (medium density fiber panels) having a density of 750 to 950 kg/m$^3$ and a UF or MUF bonding are especially suitable. These panels are obtainable, as a standardized DIN 622 Part 5 type, from manufacturers such as Kronospan, Menznau, Switzerland, or Kaindl, Salzburg, Austria, under the designation standard MDF (e.g. Fluri). As lining carriers, MDF panels can preferably be used in a thickness from 3 to 6 mm. Thickness of 4.4 to 5 mm are especially suitable.

WPC is a composite of wood fibers and thermoplastics. In the production of lining carriers according to the invention from WPC, wood fibers are dried and mixed with a high-density polyethylene (HDPE). When subjected to high temperatures, the HDPE plasticizes and completely encloses the wood fibers. A WPC granulate is produced. Mix ratios of 60:40 to 85:15 of natural fiber to thermoplastics have proved to be especially suitable.

Figure 1:
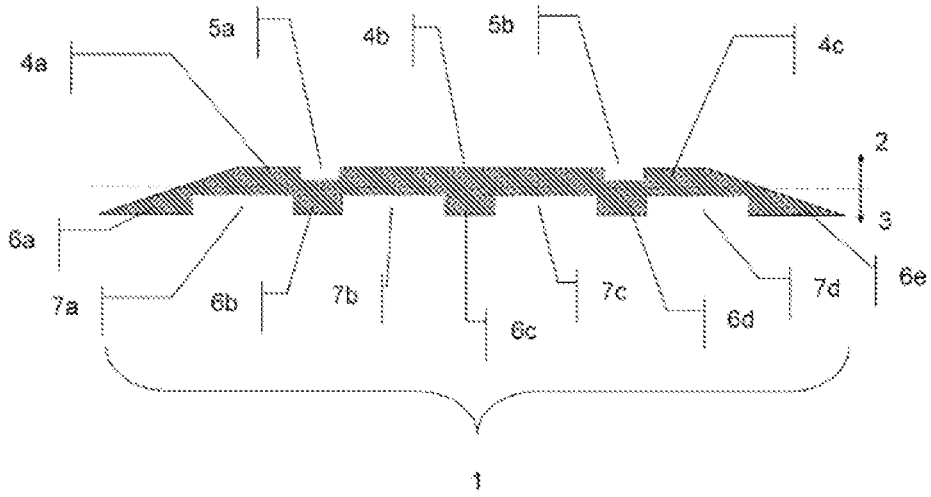
FIG. 1 shows a schematic sectional representation of a lining carrier 1 having a plurality of webs and resultant grooves.

Extrusion is suitable for the production of lining carriers according to the invention from WPC. The granulate is fed into an extruder, melted and compressed. An opening for shaping the profiles according to the invention (see, for example, FIGS. 1, 6, 7 or) is used to extrude the lining carrier. The resultant lining carrier is cooled in a water cooling bath and cut into appropriate lengths, for example into lengths of 600 mm to 5000 mm.

The invention claimed is:

1. A lining carrier for a sanding-shoe lining, wherein the lining carrier has at least one recess for the purpose of heat exchange with the environment and wherein the lining carrier has at least one stop face for taking up transverse forces, wherein the lining carrier has a swallowtail-shaped profile.

2. The lining carrier as claimed in claim 1, wherein the recess is a groove.

3. The lining carrier as claimed in claim 1, wherein the recess is on a face of the lining carrier that is to face toward the lining.

4. The lining carrier as claimed in claim 1, wherein the recess is formed by at least two webs, which enclose a groove.

5. The lining carrier as claimed in claim 4, wherein the recess is in the longitudinal axis of the lining carrier.

6. The lining carrier as claimed in claim 1, wherein the lining carrier has a length of between 600 mm and 4000 mm.

7. The lining carrier as claimed in claim 1, wherein the lining carrier has at least five webs.

8. The lining carrier as claimed in claim 1, wherein the lining carrier has a width of between 60 mm and 1000 mm.

9. The lining carrier as claimed in claim 1, wherein the lining carrier contains or is composed of a non-metallic material.

10. The lining carrier as claimed in claim 9, wherein the non-metallic material contains or is composed of at least one of a wood material and a cotton material.

11. The lining carrier as claimed in claim 9, wherein the lining carrier contains or is composed of a composite material.

12. A sanding-shoe lining, comprising a lining carrier as claimed in claim 1, and a sanding lining, which comprises at least one of a cushion layer and a slide lining.

13. The sanding-shoe lining as claimed in claim 12, wherein the cushion layer contains or is composed of a foam or a felt.

14. The sanding-shoe lining as claimed in claim 12, wherein the slide lining contains or is composed of a graphite compound.

15. A sanding shoe for pressing sanding faces on to workpieces in segment-belt and wide-belt sanding machines, comprising a carrier device and a sanding-shoe lining, wherein the carrier device is designed to accommodate the sanding-shoe lining substantially with a precise fit, wherein there is at least one recess between the sanding-shoe lining and the carrier device, for the purpose of heat exchange with the environment, wherein the at least one recess is formed on or at the side of the sanding-shoe lining that faces toward the carrier device.

16. A lining carrier for a sanding-shoe lining, wherein the lining carrier has at least one recess for the purpose of heat exchange with the environment, wherein the lining carrier has a side that faces toward a carrier device when in use and has a side that faces away from the carrier device when in use, each side comprising a number of webs, wherein at least two webs enclose a groove, and recesses, and wherein the number of webs and recesses is designed so as to be different in each case.

17. The lining carrier as claimed in claim 1, wherein the side that faces toward the carrier device has six webs.

18. The lining carrier as claimed in claim 1, wherein the side that faces toward the carrier device has five webs.

19. The sanding shoe as claimed in claim 15, characterized in that the at least one recess is provided on the carrier device for heat exchange with the environment.

20. The lining carrier as claimed in claim 1, wherein the recess is on a face of the lining carrier that is to face toward the carrier device.

* * * * *